US007193170B2

(12) United States Patent
Katayama et al.

(10) Patent No.: US 7,193,170 B2
(45) Date of Patent: Mar. 20, 2007

(54) PUSH BUTTON

(75) Inventors: Yoshihiki Katayama, Tokyo (JP); Hiroomi Miyaki, Tokyo (JP); Norio Joichi, Tokyo (JP); Youbao Peng, Tokyo (JP); Yoshihito Sasamoto, Tokyo (JP); Takashi Nara, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 11/166,995

(22) Filed: Jun. 24, 2005

(65) Prior Publication Data

US 2006/0108210 A1 May 25, 2006

(30) Foreign Application Priority Data

Nov. 24, 2004 (JP) ..... 2004-339567

(51) Int. Cl.
*H01H 13/14* (2006.01)

(52) U.S. Cl. ..... 200/314; 200/310

(58) Field of Classification Search ..... 200/308–314, 200/317

See application file for complete search history.

(56) References Cited

U.S. PATENT DOCUMENTS 5,401,927 A * 3/1995 Lundell et al. ..... 200/314
5,920,050 A * 7/1999 Tolman ..... 200/302.2
6,224,221 B1 5/2001 Glienicke
6,350,039 B1 * 2/2002 Lee ..... 362/95
6,365,855 B1 * 4/2002 Sutter et al. ..... 200/314
6,664,489 B2 * 12/2003 Kleinhans et al. ..... 200/313
6,744,374 B1 * 6/2004 Kuenzner ..... 340/815.78
2003/0112160 A1 * 6/2003 Hsiung et al. ..... 341/31

FOREIGN PATENT DOCUMENTS

EP 0 567 357 A1 10/1993
EP 1 418 601 A2 5/2004
EP 1 467 387 A1 10/2004
JP 2001-307595 A 11/2001

* cited by examiner

*Primary Examiner*—Elvin Enad
*Assistant Examiner*—M. Fishman
(74) *Attorney, Agent, or Firm*—Frishauf, Holtz, Goodman & Chick, P.C.

(57) ABSTRACT

A push button includes a button main body portion which is provided between a packaging substrate placed under it and a casing portion located above it, a light source placed on the packaging substrate, and a light-guide portion which guides light from the light source to an outer periphery of the button main body portion by reflection.

16 Claims, 6 Drawing Sheets

PUSH BUTTON

This application is based on and claims the priority under 35 U.S.C. § 119 from the Japanese Patent Application No. 2004-339567 filed in Japan on Nov. 24, 2004, the entire content of which is incorporated herein by reference.

BACKGROUND OF THE INVENTION

1. Field of the Invention

The present invention relates to a push button and, more particularly, to a push button having an illumination structure which can illuminate its outer periphery.

2. Description of the Related Art

Conventionally, an electrophotographic image forming apparatus such as a digital copying machine is known well in which the photosensitive layer of a uniformly charged photosensitive drum is exposed by being illuminated with light to form a latent image. Toner is attached to the photosensitive layer having the latent image to develop the latent image. The latent image is transferred to a sheet to form an image.

Conventionally, a push button is employed often to allow the user to instruct various operations to various types of apparatuses. For example, in an image forming apparatus such as a digital copying machine, a push button can be employed as a copy button which instructs execution of copying operation.

Such a push button sometimes has an illumination structure which illuminates the button from below to indicate whether or not the push button is in an active state, to make the push button stand out, or to improve the appearance.

For example, a button illumination structure described in Japanese Unexamined Patent Publication No. 2001-307595 (patent reference 1) comprises a hollow button with an upper portion made of a light-transmitting material. A light-emitting diode is provided under the button. Light emitted from below the button is transmitted through the upper portion of the button so that the user can recognize the light.

When the push button is illuminated from below so the user recognizes light emission of the push button, assume that the push button has a structure such as the illumination structure of the button of the patent reference 1. When the upper portion of the button and the light source are set close to each other to make a low-profile button component, the light source illuminates only the central portion of the button. In case that light emission is to be obtained around the button, the outer periphery of the button cannot be illuminated efficiently.

If the upper portion of the button and the light source are spaced apart from each other so the light diffuses to illuminate the outer periphery of the button as well, a low-profile button component cannot be obtained. As the upper portion of the button and the light source are spaced apart from each other, light emission to the user results in low illuminance.

SUMMARY OF THE INVENTION

The present invention has been made in view of the above drawbacks, and has as its object to provide a push button having an illumination structure which can illuminate the outer periphery of the button without decreasing the illuminance while realizing a low-profile button component.

An aspect of the present invention is a push button for pushing a switch, comprising a button main body portion which is provided between a packaging substrate placed thereunder and a casing portion located thereabove, a light source placed on the packaging substrate, and a light-guide portion which guides light from the light source to an outer periphery of an upper surface of the button main body portion by reflection.

Another aspect of the present invention is an image forming apparatus comprising a push button as described above.

The above and many other objects, features and advantages of the present invention will become manifest to those skilled in the art upon making reference to the following detailed description and accompanying drawings in which a preferred embodiment incorporating the principle of the present invention are shown by way of illustrative examples.

DETAILED DESCRIPTION OF THE PREFERRED EMBODIMENT

As described above, an aspect of the invention is a push button for pushing a switch, comprising a button main body portion which is provided between a packaging substrate placed thereunder and a casing portion located thereabove, a light source placed on the packaging substrate, and a light-guide portion which guides light from the light source to an outer periphery of an upper surface of the button main body portion by reflection.

In the aspect, it is preferable that the light-guide portion has a light-input portion where light from the light source enters. Further the light-input portion is preferably forms a projection toward the light source.

Further, the light-guide portion preferably has a light-emitting portion which emits light from the light source through an outer periphery of the button main body portion. The light-emitting portion preferably has an embossed surface.

A reflection surface is preferably formed at an appropriate portion of the outer surface of the light-guide portion.

A shielding member is preferably arranged between the packaging substrate and casing portion to surround the light-guide portion.

As apparent from the above aspects, a push button having an illumination structure which can illuminate the outer periphery of a button without or substantially without decreasing the illuminance can be provided while realizing a low-profile button component.

Namely, due to the presence of the light-guide portion, light can be guided to the outer periphery of the button main body portion efficiently, thus realizing a low-profile button component.

As the surface of the light-emitting portion of the light-guide portion is embossed, nonuniformities in light emission in the light-emitting portion can be eliminated.

A preferred embodiment of the present invention will be described with reference to the accompanying drawings.

In this embodiment, a case will be described wherein a push button according to the present invention is applied to a copy button in the display operation unit of an image forming apparatus.

Figure 1:
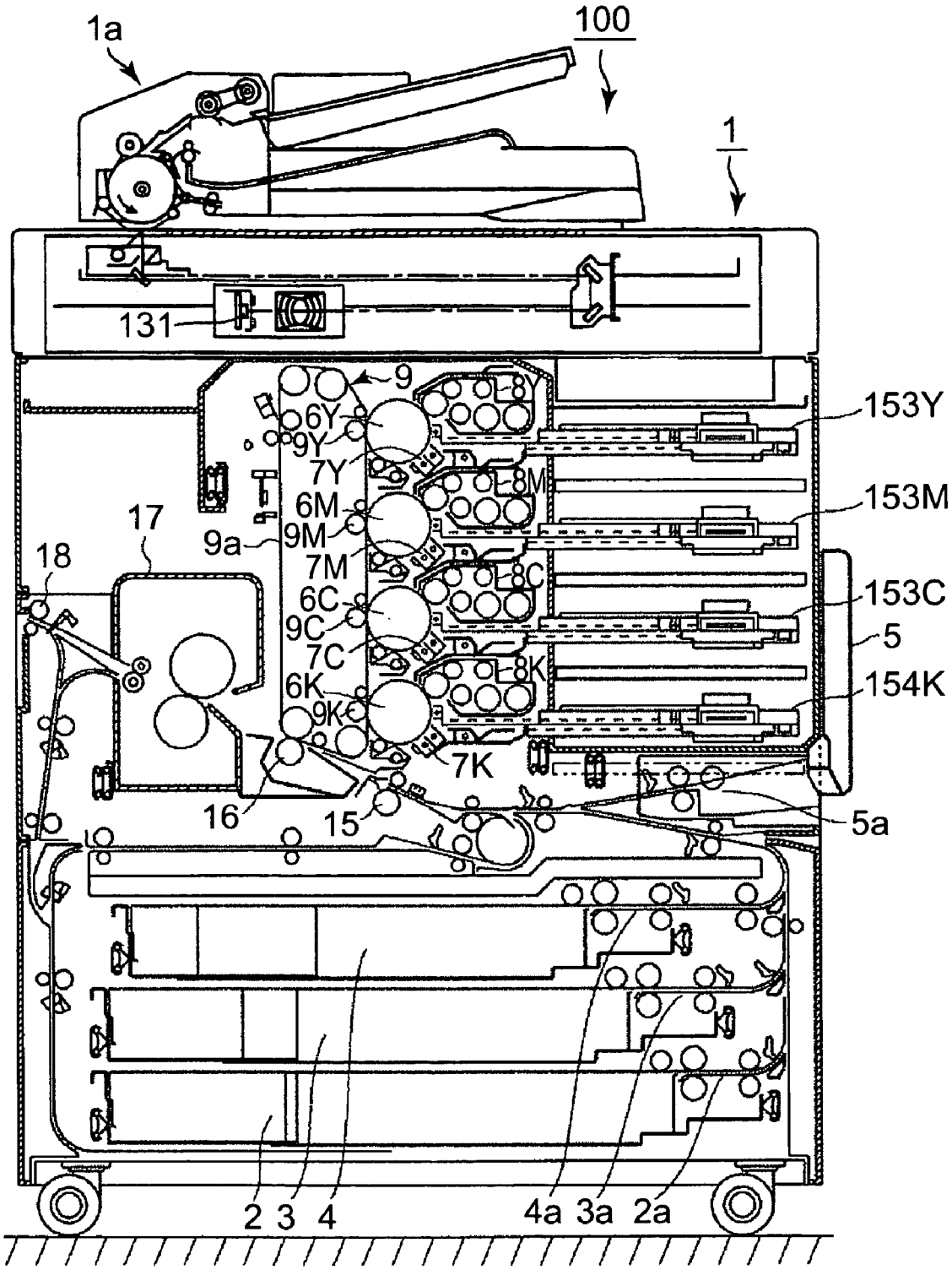
FIG. 1 is a schematic sectional view showing the arrangement of an image forming apparatus to which a push button of an embodiment of the present invention is applied.

FIG. 1 is a schematic sectional view showing the arrangement of an image forming apparatus to which a push button according to an embodiment of the present invention is applied.

The image forming apparatus will be exemplified by an electrophotographic copying machine.

The arrangement and basic operation of an image forming apparatus 100 to which a push button of this embodiment is applied will be described with reference to FIG. 1.

The image forming apparatus main body 100 comprises a plurality of sets of original write units 153Y, 153M, and 153C as color image forming means, and an original write unit 154K as a black-and-white image forming means. The original write units 153Y, 153M, 153C, and 154K can respectively form yellow, magenta, cyan, and black images.

Photosensitive drums 6Y, 6M, 6C, and 6K, charging means 7Y, 7M, 7C, and 7K, and developing means 8Y, 8M, 8C, and 8K are respectively provided to the original write units 153Y, 153M, 153C, and 154K. An intermediate transfer unit 9 is provided to be shared by the color image forming means and black-and-white image forming means. The intermediate transfer unit 9 has an endless belt-type intermediate transfer body 9*a* and primary transfer means 9Y, 9M, 9C, and 9K. The intermediate transfer body 9*a* is wound around a plurality of rollers, supported rotatably, and arranged to be able to come into contact with the photosensitive drums 6Y, 6M, 6C, and 6K. The primary transfer means 9Y, 9M, 9C, and 9K bring the intermediate transfer body 9*a* into contact with the photosensitive drums 6Y, 6M, 6C, and 6K to transfer the images.

An arrangement other than this will be described. An original read unit 1 which serves as a scanner is provided in the upper portion of the image forming apparatus 100. An origin is set on a glass platen surface and scanned and read by the original read unit 1. A CCD 131 to which reflection light obtained by the scanning operation is arranged in the original read unit 1. The original read unit 1 is desirably connected to an ADF (Automatic Document Feeder) la so that the two surfaces of the original can be read.

Paper feed trays 2, 3, and 4 are arranged in the lower portion of the image forming apparatus 100 and respectively provided with paper feeding means 2*a*, 3*a*, and 4*a*. A manual feed tray 5 is arranged on the outer wall portion of the side portion of the image forming apparatus main body 100, and a paper feeding means 5*a* is provided for the manual feed tray 5. Since the plurality of paper feed trays and the manual feed tray are provided in this manner, a plurality of types of paper sheets having different sizes can be used.

Registration rollers 15 are arranged ahead on the paper sheet side of the paper feeding means 2*a* to 5*a*, and secondary transfer rollers 16 which can press a paper sheet against the intermediate transfer body 9*a* are arranged further ahead of the registration rollers 15.

A fixing means 17 is arranged ahead of the secondary transfer rollers 16, and delivery rollers 18 are arranged ahead of the fixing means 17.

In the image forming apparatus 100, when color printing is to be performed in response to an image formation instruction, images formed by the original write units 153Y, 153M, 153C, and 154K as required are transferred to the intermediate transfer body 9*a* by the photosensitive drums 6Y, 6M, 6C, and 6K, charging means 7Y, 7M, 7C, and 7K, developing means 8Y, 8M, 8C, and 8K, and primary transfer means 9Y, 9M, 9C, and 9K. When black-and-white printing is to be performed, an image formed by the original write unit 154K is transferred to the intermediate transfer body 9*a* by the photosensitive drum 6K, charging means 7K, developing means 8K, and primary transfer means 9K.

A paper sheet necessary for image formation is fed from one of the paper feed trays 2, 3, and 4, or from the manual feed tray 5 by the paper feeding means 2*a*, 3*a*, or 4*a*, or 5*a* in accordance with the sheet size or the like and reaches the secondary transfer rollers 16 via the registration rollers 15. The paper sheet is pressed by the secondary transfer rollers 16 against the intermediate transfer body 9*a*, so that the image on the intermediate transfer body 9*a* is transferred onto the paper sheet. The image which is transferred to the paper sheet is fixed by the fixing means 17. The paper sheet is then delivered outside the image forming apparatus 100 via the delivery rollers 18.

Figure 2:
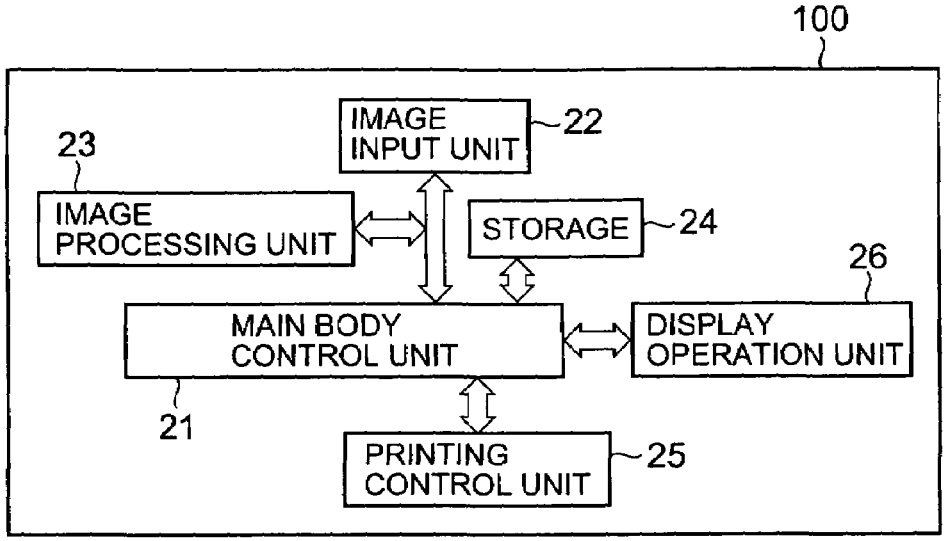
FIG. 2 is a block diagram showing an arrangement concerning control of an image forming apparatus main body 100 shown in FIG. 1.

FIG. 2 is a block diagram showing an arrangement concerning control of the image forming apparatus main body 100 shown in FIG. 1.

As shown in FIG. 2, the image forming apparatus main body 100 comprises a main body control unit 21, image input unit 22, image processing unit 23, printing control unit 25, storage 24, and display operation unit 26. The main body control unit 21 controls the entire image forming apparatus main body 100. The image input unit 22 has the original read unit 1 and reads an image from the original. The image processing unit 23 performs an arbitrary image process, e.g., compression or enlargement, of the image data. The printing control unit 25 has the original write units 153Y, 153M, 153C, and 154K and forms an image on an image forming sheet such as paper. The storage 24 stores image data read by the image input unit 22, a software program to run on the main body control unit 21, and parameters or the like necessary for the operation of the image forming apparatus 100. The display operation unit 26 displays information from the image forming apparatus main body 100 to the user. The user inputs an operation instruction for the image forming apparatus main body 100 from the display operation unit 26.

Figure 3:
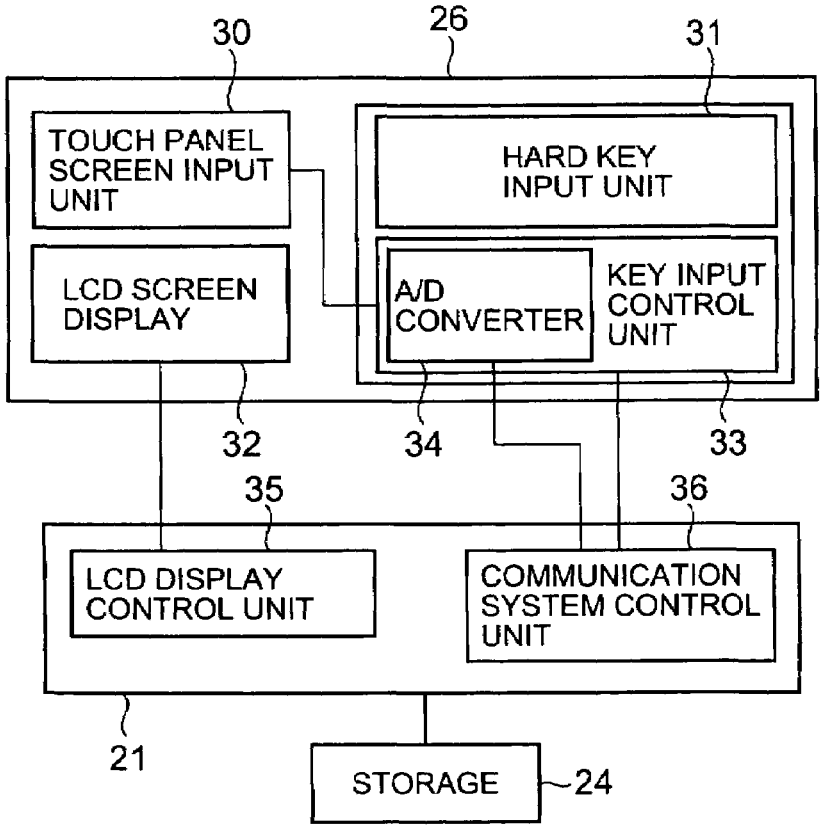
FIG. 3 is a block diagram showing the arrangement of a display operation unit 26 shown in FIG. 2.

FIG. 3 is a block diagram showing the arrangement of the display operation unit 26 shown in FIG. 2.

The operational portion of the display operation unit 26 comprises a touch panel screen input unit 30 serving as the input portion of a touch panel type operation panel and a hard key input unit 31 serving as an input portion having fixed buttons such as push buttons. The display operation unit 26 is provided with an LCD screen display 32 serving as the display of the touch panel type operation panel. A copy button to which a push button of this embodiment is applied is provided to the hard key input unit 31.

The LCD screen display 32 may be a display panel such as a CRT, liquid crystal, or EL display panel. The touch panel screen input unit 30 may be an input device such as a touch panel or mouse which detects coordinates corresponding to the button position of the display panel.

Although not shown in FIG. 1, the display operation unit 26 is preferably arranged at a position of the upper stage of the image forming apparatus main body 100 where the user can operate the display operation unit 26 easily.

The LCD screen display 32 controls the display content or the like by an LCD display control unit 35 of the main body control unit 21.

An input result of the user from the touch panel screen input unit 30 is detected by a key input control unit 33. The analog input result is A/D-converted by an A/D converter 34 and transmitted to a communication system control unit 36 of the main body control unit 21.

An input result of the user from the hard key input unit 31 is detected by the key input control unit 33 and transmitted to the communication system control unit 36 of the main body control unit 21.

Figure 4:
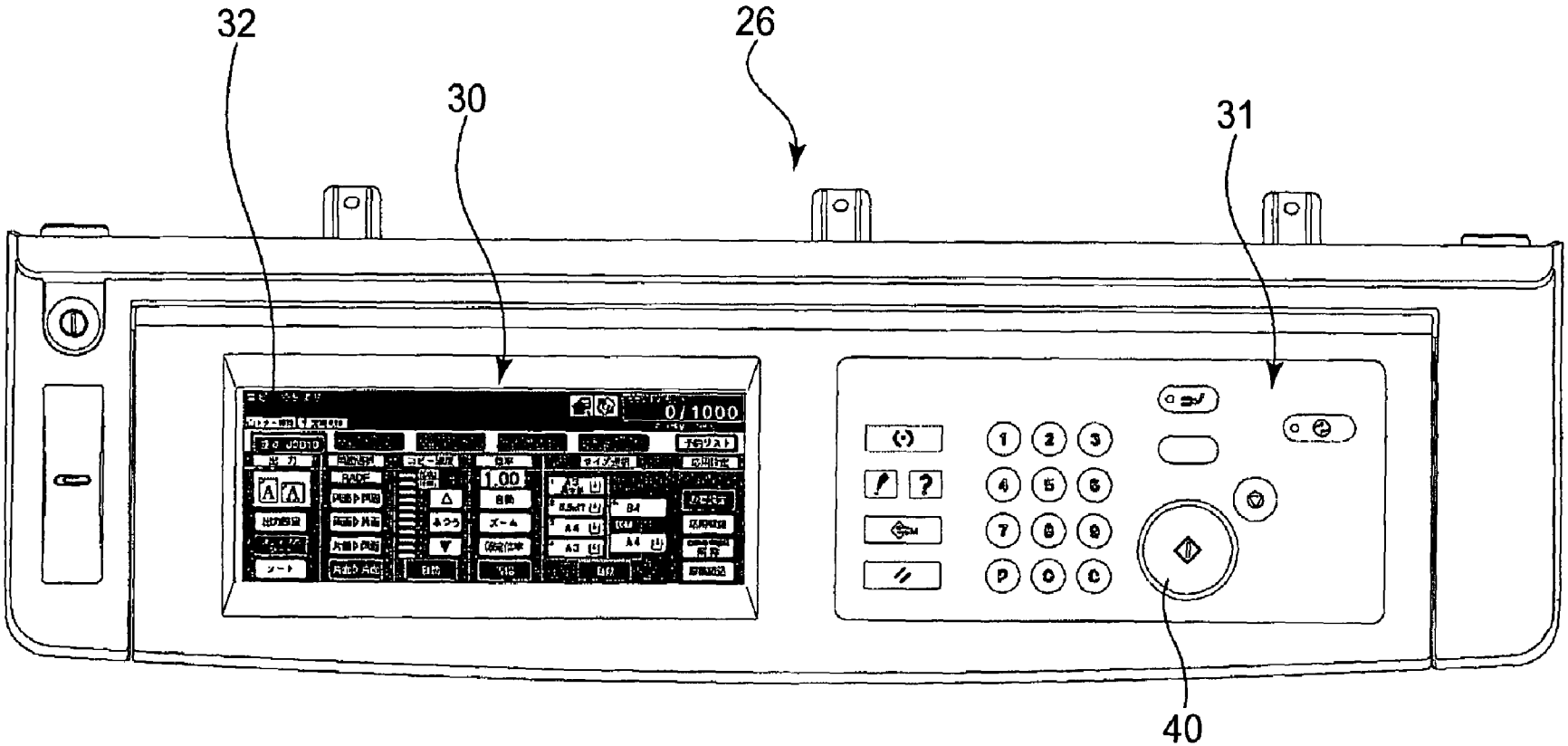
FIG. 4 is a plan view showing the outline of the display operation unit 26 shown in FIG. 2.

FIG. 4 is a plan view showing the outline of the display operation unit 26 shown in FIG. 2.

In this example, as shown in FIG. 4, the LCD screen display 32 and touch panel screen input unit 30 respectively serving as the display and operation unit are arranged on the left side, and the hard key input unit 31 is arranged on the right side. A copy button 40 serving as a pressure type input means, i.e., a push button, with which the user instructs copy operation is arranged on the hard key input unit 31.

The structure of the copy button 40 of this embodiment will be described in detail with reference to the accompanying drawings.

Figure 5:
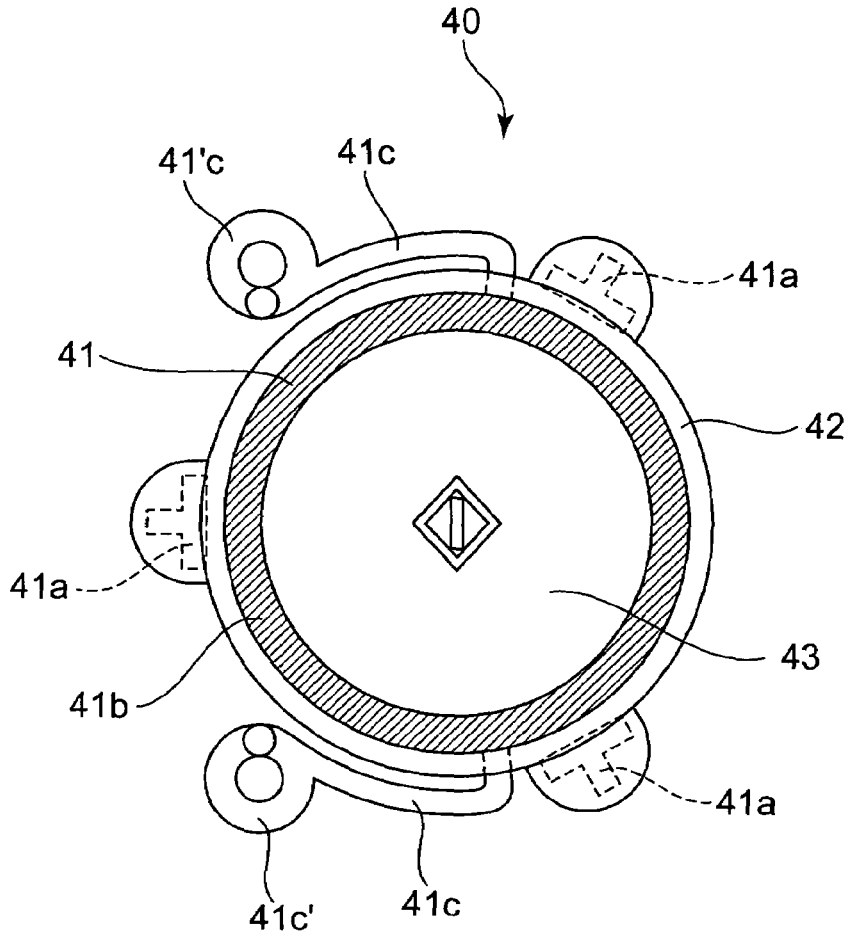
FIG. 5 is a plan view showing the structure of a copy button 40 of the embodiment shown in FIG. 4.

FIG. 5 is a plan view showing the structure of the copy button 40 of the embodiment shown in FIG. 4.

Figure 6:
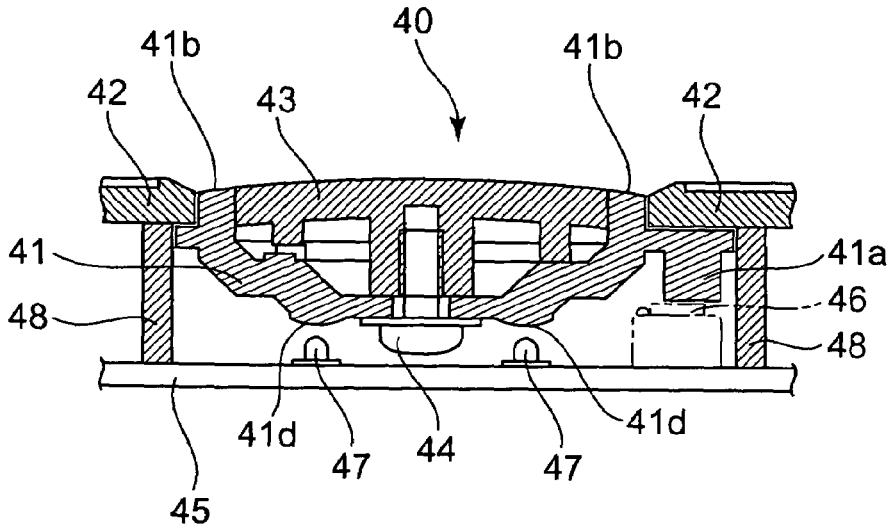
FIG. 6 is a longitudinal sectional view showing the structure of the copy button 40 of the embodiment shown in FIG. 4.

FIG. 6 is a longitudinal sectional view showing the structure of the copy button 40 of the embodiment shown in FIG. 4.

Figure 7:
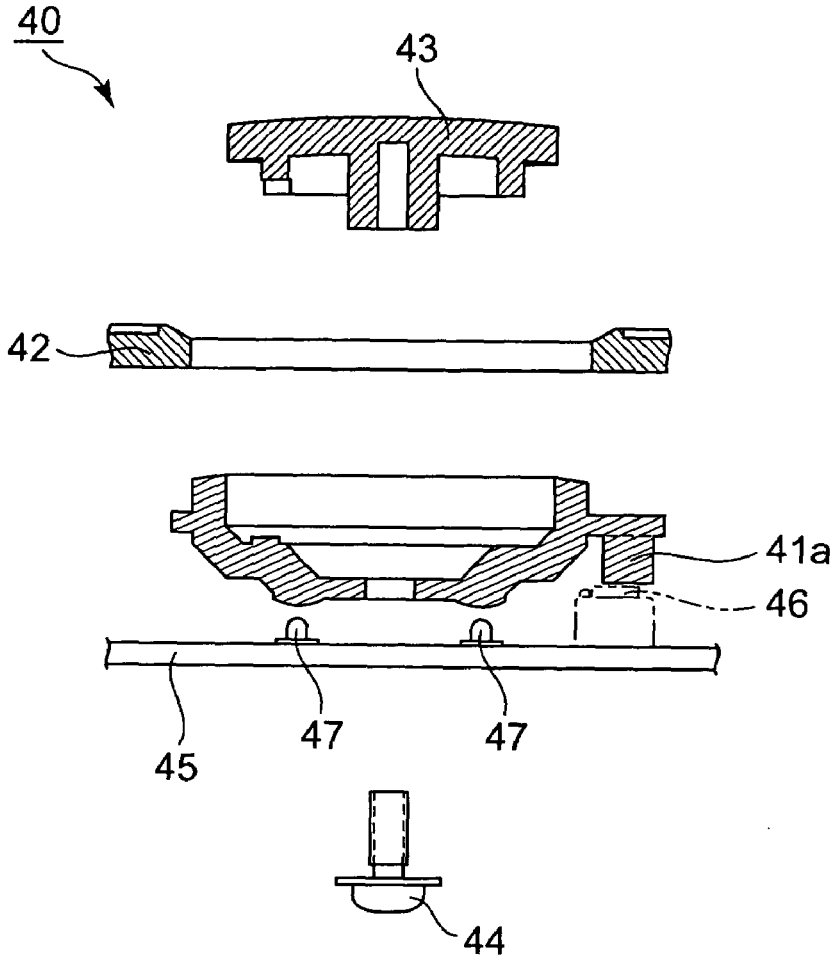
FIG. 7 is an exploded longitudinal sectional view showing the structure of the copy button 40 of the embodiment shown in FIG. 4.

FIG. 7 is an exploded longitudinal sectional view showing the structure of the copy button 40 of the embodiment shown in FIG. 4.

As shown in FIGS. 5, 6, and 7, the copy button 40 as the push button of this embodiment is formed by placing a button main body portion 43 on a light-guide portion 41 and connecting them with a connection screw 44. For the sake of the appearance of the copy button 40, if the light-guide portion 41 is to transmit light and the button main body portion 43 is not, the button main body portion 43 may be formed of a non-transparent member.

As shown in FIG. 5, support springs 41*c* are provided to the light-guide portion 41. Distal ends 41*c*' of the support springs 41*c* are fixed to the upper surface of a packaging substrate 45 shown in FIG. 6 (the support springs 41*c* are omitted in FIGS. 6 and 7 for visual convenience). The elastic forces of the support springs 41*c* serve to lift the light-guide portion 41 upward, to urge and fix it against and to a casing portion 42 serving as the panel of the peripheral portion of the copy button 40 of the hard key input unit 31, as shown in FIG. 6.

When the user pushes the copy button 40, the light-guide portion 41 is pushed down against the elastic forces of the support springs 41*c*. Switch pushing portions 41*a* provided to the light-guide portion 41 push down switches 46. Thus, the key input control unit 33 detects that the copy button 40 is pushed.

The light-guide portion 41 has a light-input portion 41*d* and light-emitting portion 41*b*. The light-input portion 41*d* is made of a material, e.g., an acrylic resin or glass, which is transparent and has a strength to serve as a button. Light from light sources 47, e.g., LEDs, enter the light-input portion 41*d*. The light-emitting portion 41*b* emits light, which has entered from the light-input portion 41*d*, toward the user. The surface of the light-emitting portion 41*b* is desirably embossed (like recesses and projections on ground glass) so nonuniformities such as bright and dark portions do not occur when the light-emitting portion 41*b* emits light. Then, the light is diffused by the surface of the light-emitting portion 41*b* to eliminate nonuniformities. Although not shown, in place of embossing the surface of the light-guide portion 41, a member that generates scattered light may be arranged at an appropriate portion or in the vicinity of the light-guide portion 41.

Regarding the numbers of the light sources 47 and light-input portions 41*d*, for example, four light sources 47 and four light-input portion 41*d* may suffice. Any number of light sources 47 and any number of light-input portions 41*d* that match the quantity of light will do. As the color of light emitted from the light sources 47, various colors can be used in accordance with the request in appearance. A plurality of light sources having different colors may be provided.

Subsequently, the light-emitting operation of the copy button 40 of this embodiment will be described with reference to FIG. 8.

Figure 8:
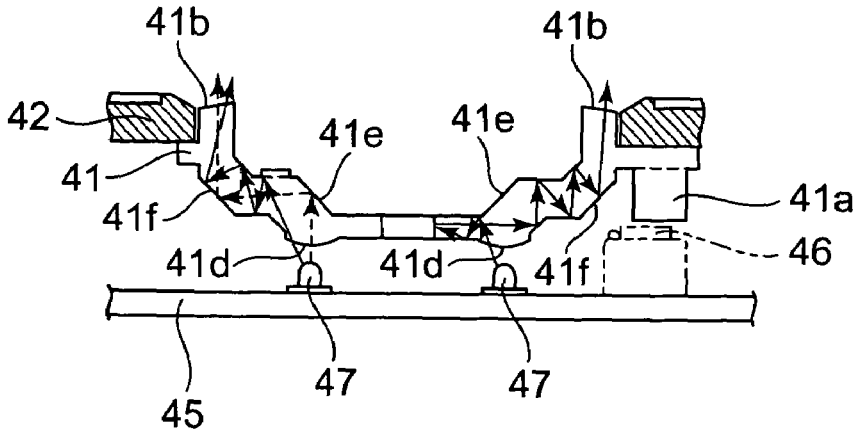
FIG. 8 is a longitudinal sectional view of a light-guide portion 41 shown in FIG. 6 to explain its light-emitting operation.

FIG. 8 is a longitudinal sectional view of the light-guide portion 41 shown in FIG. 6 to explain its light-emitting operation.

As shown in FIG. 8, the light-guide portion 41 has first and second reflection surfaces 41*e* and 41*f* which reflect light from the light sources 47. In order to improve the reflecting function, the reflection surfaces 41*e* and 41*f* are subjected to the following processes. For example, the lower surfaces of the reflection surfaces may be dyed white, the reflection surfaces may be covered with white members, or the reflection surfaces themselves may form specular surfaces.

The light-input portion 41*d* forms a projection so that light from the light sources 47 is focused on the light-input portion 41*d* and enters the first reflection surface 41*e* as much as possible.

The light entering the first reflection surface 41*e* is reflected by the first reflection surface 41*e* and enters the second reflection surface 41*f*. Light which does not enter the first reflection surface 41*e* is reflected by the other surfaces of the light-guide portion 41 and enters the second reflection surface 41*f*.

The light entering the second reflection surface 41*f* is reflected by the second reflection surface 41*f* and is emerges from the light-emitting portion 41*b* toward the user.

In order that the light from the light sources 47 is emitted through the light-emitting portion 41*b* efficiently, the upper surface of the packaging substrate 45 is desirably dyed white, covered with a white member, formed as a specular surface, or the like so that it has a good reflection efficiency. In order to prevent light from the light sources 47 from leaking horizontally between the casing portion 42 and packaging substrate 45 to decrease the focusing efficiency, a shielding member 48 which shields light in the horizontal direction may be provided. At this time, the inner surface of the shielding member 48 may be dyed white, covered with a white member, formed as a specular surface, or the like so that it has a good reflection efficiency.

A result will be shown which is obtained by comparing the emission performance of the light-emitting portion 41*b* of the copy button 40 serving as the push button of this embodiment with that of a reference example.

Figure 9A:
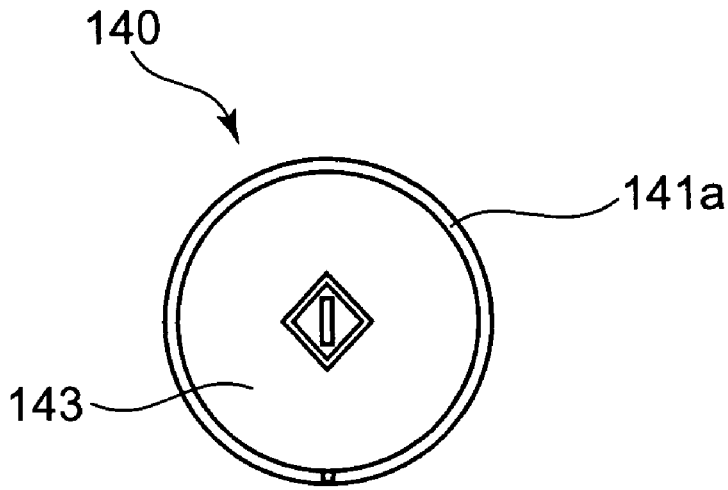
FIGS. 9A and 9B are plan and longitudinal views, respectively, showing the arrangement of a push button as a reference to be compared with this embodiment.
Figure 9B:
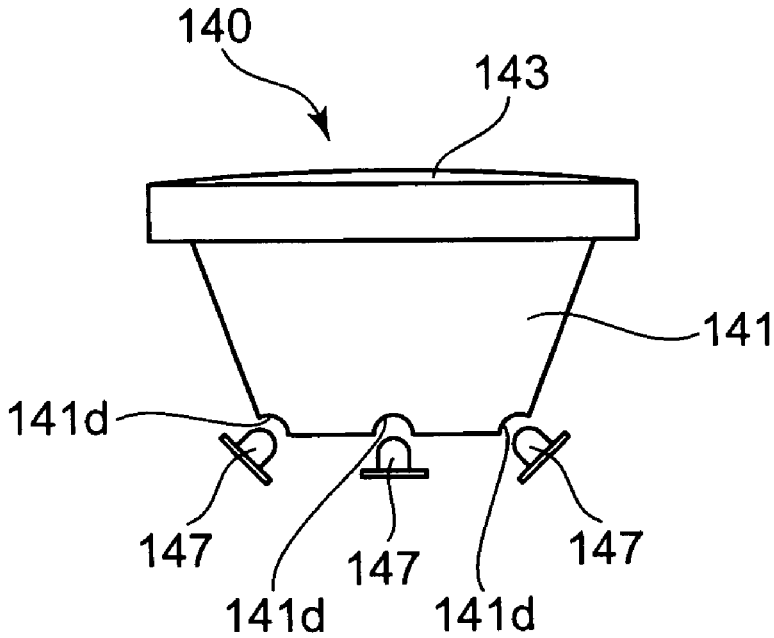

FIGS. 9A and 9B are plan and longitudinal views, respectively, showing the arrangement of a push button as a reference to be compared with this embodiment, in which FIG. 9A is a plan view of the push button of the reference, and FIG. 9B is a longitudinal view of the push button of the reference.

As shown in the plan view of FIG. 9A, a push button 140 of this reference has a button main body portion 143. A light-emitting portion 141*b* which emits light toward the user is formed around the button main body portion 143. As shown in the longitudinal view of FIG. 9B, the push button 140 has a light-guide portion 141 which guides light to the light-emitting portion 141*b*. The light-guide portion 141 has light-input portions 141*d* where light from light sources. 147 enters.

According to this reference, to direct light from the light sources 147 to the light-emitting portion 141*b* around the button main body portion 143, the light from the light sources 147 must be diffused by the light-guide portion 141 outwardly of the button main body portion 143. For this purpose, a certain distance is required between the light-input portions 141*d* and light-emitting portion 141*b*. For the light diffusion, the light-input portions 141*d* are formed as recesses.

Actual brightness was measured in this reference, a case of the above embodiment in which the light-emitting portion 41*b* is not embossed, and a case of the above embodiment in which the light-emitting portion 41*b* is embossed. Table 1 shows the measurement results.

In Table 1, the number of the light sources is the same (four) between the reference and this embodiment.

TABLE 1

| | Brightness on Upper Surface of Button (mcd) | Density Nonuniformities {(Brightness at Dark Portion)/(Brightness at Bright Portion)} |
|---|---|---|
| Reference | 5.9 | 59.3% |
| This Embodiment (Non-Embossed) | 6.4 | 57.1% |
| This Embodiment (Embossed) | 7.0 | 100.0% |

As shown in Table 1, according to this embodiment, light can be transmitted from the upper surface of the button more brightly than in the reference. If the light-emitting portion 41*b* is embossed, the density nonuniformities can be eliminated.

What is claimed is:

1. A push button for pushing a switch, comprising:

a button main body portion which is provided over a substrate;

a light source placed on said substrate; and a light-guide portion which guides light from said light source to an outer periphery of an upper surface of said button main body portion by reflection;

wherein said light-guide portion includes a light-input portion where light from said light source enters, and wherein said light-input portion comprises a curved projection including a curved face projecting toward said light source.

2. The button according to claim 1, wherein said light-guide portion includes a light-emitting portion which emits light from said light source through the outer periphery of said button main body portion, and wherein a surface of the light-emitting portion is embossed so as to substantially eliminate non-uniformities of light emission therefrom.

3. The button according to claim 1, wherein a reflection surface is formed at at least one portion of an outer surface of said light-guide portion.

4. The button according to claim 3, wherein a lower surface of said reflection surface is dyed white.

5. The button according to claim 3, wherein a lower surface of said reflection surface is covered with a white member.

6. The button according to claim 3, wherein said reflection surface is subjected to a specular finish.

7. The button according to claim 1, further comprising at least one additional light source.

8. The button according to claim 7, wherein at least two of the light sources emit different light.

9. The button according to claim 1, further comprising at least one additional light-input portion.

10. The button according to claim 1, wherein a casing portion is provided at a periphery of the upper surface of the button main body portion, and a shielding member which surrounds said light-guide portion is arranged between said substrate and the casing portion.

11. The button according to claim 1, wherein an upper surface of said substrate is dyed white.

12. The button according to claim 1, wherein an upper surface of said substrate is covered with a white member.

13. The button according to claim 1, wherein an upper surface of said substrate is subjected to a specular finish.

14. An image forming apparatus which comprises the push button according to claim 1.

15. The button according to claim 1, wherein the button main body portion is formed of a non-transparent member.

16. The button according to claim 1, wherein the light-input portion faces the light source.

* * * * *